US009415838B2

(12) United States Patent
Van Diepen

(10) Patent No.: US 9,415,838 B2
(45) Date of Patent: Aug. 16, 2016

(54) EXOSKELETON SHIP HULL STRUCTURE

(71) Applicant: NaviForm Consulting & Research Ltd., Vancouver (CA)

(72) Inventor: Peter Van Diepen, Vancouver (CA)

(73) Assignee: NaviForm Consulting & Research Ltd., Vancouver (CA)

( * ) Notice: Subject to any disclaimer, the term of this patent is extended or adjusted under 35 U.S.C. 154(b) by 0 days.

(21) Appl. No.: 14/340,078

(22) Filed: Jul. 24, 2014

(65) Prior Publication Data

US 2016/0023717 A1 Jan. 28, 2016

(51) Int. Cl.

| | |
|---|---|
| ***B63B 5/00*** | (2006.01) |
| ***B63B 3/34*** | (2006.01) |
| ***B63B 3/12*** | (2006.01) |
| ***B63B 3/16*** | (2006.01) |
| ***B63B 3/48*** | (2006.01) |
| *B63B 3/14* | (2006.01) |
| *B63B 25/00* | (2006.01) |

(52) U.S. Cl.
CPC ... *B63B 3/34* (2013.01); *B63B 3/16* (2013.01); *B63B 3/48* (2013.01); *B63B 25/004* (2013.01); *B63B 2003/145* (2013.01)

(58) Field of Classification Search
CPC ..... B63B 5/00; B63B 3/34; B63B 3/16
USPC ..... 114/83, 60
See application file for complete search history.

(56) References Cited

U.S. PATENT DOCUMENTS

| | | | | |
|---|---|---|---|---|
| 1,661,529 | A | 3/1928 | Ellis | |
| 2,175,983 | A * | 10/1939 | Walsh | B63B 3/00 114/79 R |
| 3,038,432 | A | 6/1962 | Goldman | |
| 3,807,338 | A * | 4/1974 | Shader | B63B 35/732 114/283 |
| 3,830,177 | A | 8/1974 | Nemec et al. | |
| 3,835,800 | A | 9/1974 | Lloyd et al. | |
| 4,046,092 | A * | 9/1977 | Tornqvist | B63B 25/00 114/61.31 |
| 4,075,860 | A | 2/1978 | Hansen | |
| 4,147,123 | A | 4/1979 | Kirby et al. | |
| 4,150,635 | A | 4/1979 | Lloyd et al. | |
| 4,290,379 | A * | 9/1981 | Carter | A62C 29/00 114/26 |
| 4,471,708 | A * | 9/1984 | Wilson | A62C 3/10 114/265 |
| 4,870,919 | A * | 10/1989 | Allison | B63B 1/20 114/288 |
| 5,111,764 | A * | 5/1992 | D'Ettorre | B63B 35/003 114/259 |
| 5,218,919 | A * | 6/1993 | Krulikowski, III | B63B 3/20 114/74 A |
| 5,359,952 | A | 11/1994 | Klundt et al. | |
| 6,209,474 | B1 * | 4/2001 | Foss | B63B 35/003 114/125 |
| 6,276,875 | B1 * | 8/2001 | Gunnar | B63B 35/003 114/260 |
| 6,550,408 | B1 | 4/2003 | Janssen | |
| 7,093,550 | B2 | 8/2006 | Williamson et al. | |
| 7,111,571 | B2 | 9/2006 | Kosomaa et al. | |
| 2007/0017864 | A1 * | 1/2007 | Price | B63H 19/00 210/603 |

(Continued)

FOREIGN PATENT DOCUMENTS

| | | |
|---|---|---|
| CA | 993276 | 7/1976 |
| CA | 2259276 | 11/1998 |
| FR | 2954933 | 7/2011 |

*Primary Examiner* — Lars A Olson
*Assistant Examiner* — Jovon Hayes
(74) *Attorney, Agent, or Firm* — Richard D Okimaw

(57) ABSTRACT

A vessel comprising a hull having a length, a main deck located above and rigidly connected to the hull and at least one beam extending substantially along the length of the hull at a position spaced above the deck, wherein the beam is rigidly connected to and longitudinally reinforces the deck and the hull.

8 Claims, 5 Drawing Sheets

(56) References Cited

U.S. PATENT DOCUMENTS

2009/0084303 A1* 4/2009 Kazmierowicz ..... B63B 3/08
114/344

2010/0162935 A1* 7/2010 Khachaturian ..... B63C 3/06
114/51

2010/0307401 A1 12/2010 Bereznitski et al.

* cited by examiner

EXOSKELETON SHIP HULL STRUCTURE

BACKGROUND OF THE INVENTION

1. Field of Invention

The present invention relates to ship design in general and in particular to a ship hull having increased longitudinal strength by means of a structure external to the hull.

2. Description of Related Art

Shipping goods and materials is a common and efficient method of distributing such materials around countries and the globe. In particular for use on rivers and inland waterways barges and similarly designed powered vessels are commonly used. Such shipping requires the use of marine vessels adapted to carry an adequate amount of material to make the shipping process economical. Additionally, the vessels required for such shipping need to be sufficiently strong to support cargo, resist external loads and ensure safety of navigation.

One measure of hull strength is the hull section modulus which is a measure of geometric stiffness (expressed in length unit to third power, e.g. cu ft or m3). Marine vessels are traditionally required to have a minimum hull section modulus in order to provide adequate longitudinal strength that will prevent the hull from breaking.

As illustrated in FIGS. 1 and 2, a prior art container ship for use in inland waterways is illustrated generally at 10 comprising a hull 12, a main deck 14 located thereabove with a plurality of containers 8 located above the main deck. Such vessels commonly include a solid deck for reasons of economy of construction. Accordingly, such vessels only receive and transport containers upon the top deck surface. Longitudinal strength in such vessels is commonly achieved by increasing the size and strength of the longitudinal structural members of the vessel such as the bottom shell and the deck as well as introducing longitudinal beams 16 therealong which are used to stiffen them.

However such approach of adding additional or thicker members for the hull or deck increases the weight of the vessel thereby limiting the cargo which may be carried thereby and increasing both the cost of the vessel to construct and operate.

An additional means of longitudinally stiffening marine vessels is to increase hull depth, or the height of the deck above the bottom of the hull shell. A disadvantage of such raised deck heights in inland waterway vessels is that any shipping containers which are located thereupon are also raised thereby limiting the number of such containers which may be carried on such a vessel that is intended to pass under bridges and the like.

SUMMARY OF THE INVENTION

According to a first embodiment of the present invention there is disclosed a marine vessel comprising a hull having a length enclosing an interior volume from above by a deck and at least one beam extending substantially along the length of the hull at a position spaced above the deck, wherein the beam is rigidly connected to and longitudinally reinforces the deck and the hull.

The at least one beam may include a plurality of rigid members extending between the beam and the main deck. The at least one beam and the rigid members may form a truss. The vessel may further include trusses adjacent to each longitudinal side of the hull. The trusses may include at least one bracing beam extending transversely therebetween The vessel may further comprise bow and stern bodies extending above the main deck wherein the trusses are rigidly connected to the bow and stern. At least one of the bow and stern bodies may include one or more of personnel accommodation and machinery space.

Other aspects and features of the present invention will become apparent to those ordinarily skilled in the art upon review of the following description of specific embodiments of the invention in conjunction with the accompanying figures.

The hull may include side walls having top edges proximate to the deck. The top edges of the side walls may terminate at the deck.

BRIEF DESCRIPTION OF THE DRAWINGS

In drawings which illustrate embodiments of the invention wherein similar characters of reference denote corresponding parts in each view.

DETAILED DESCRIPTION

Figure 1:
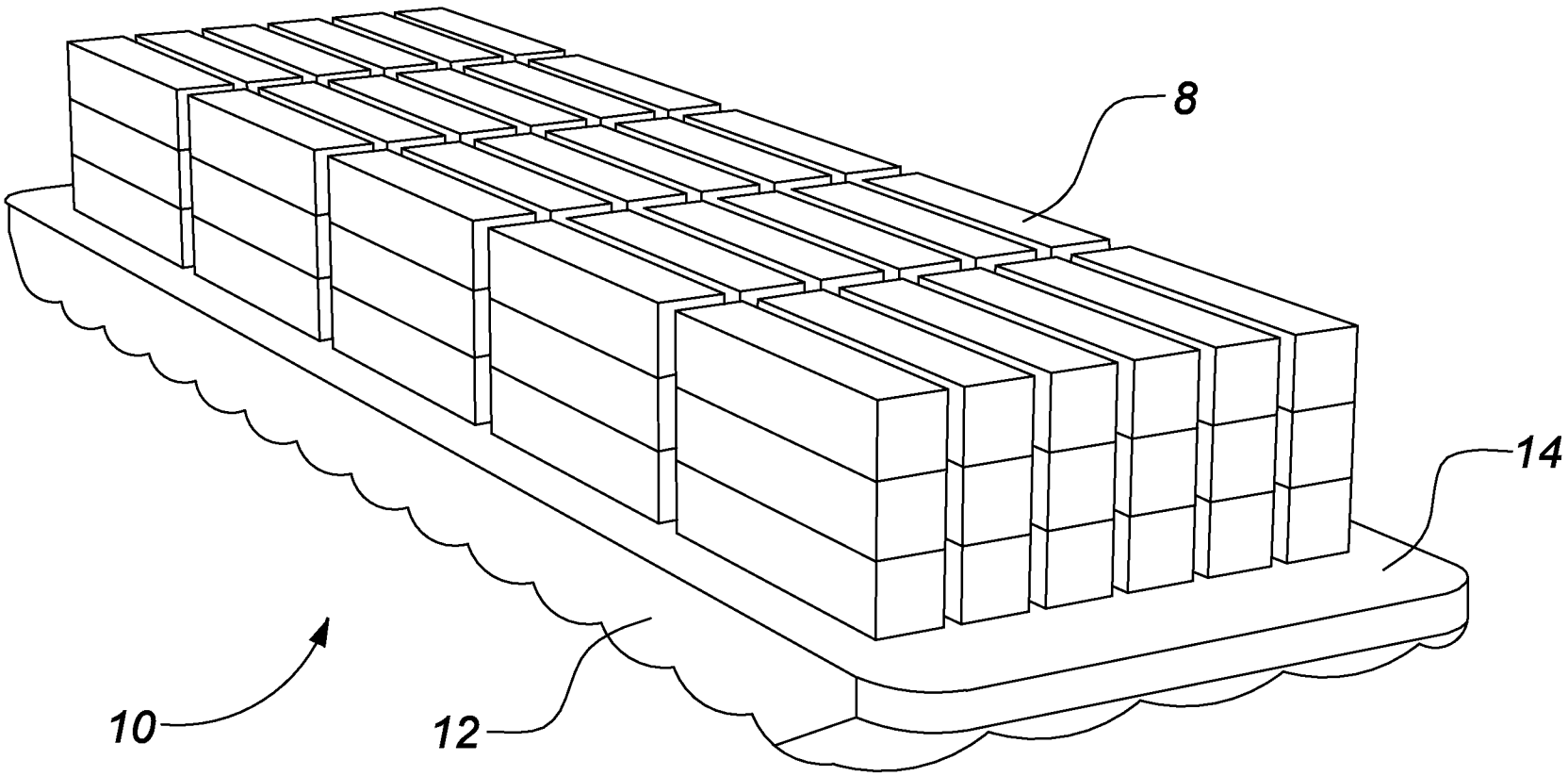
FIG. 1 is a perspective view of a prior art ship.
Figure 2:
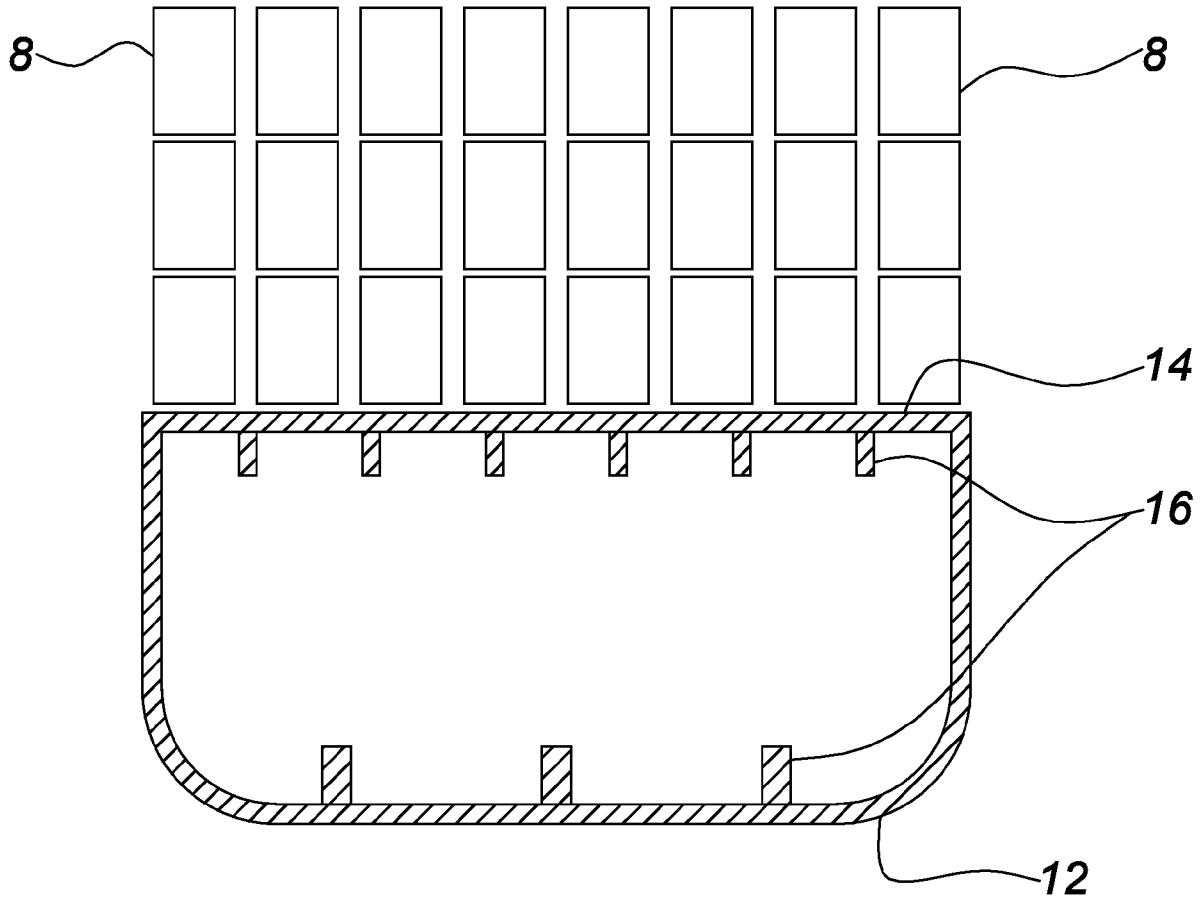
FIG. 2 is a cross sectional view of the prior art ship of FIG. 1.
Figure 3:
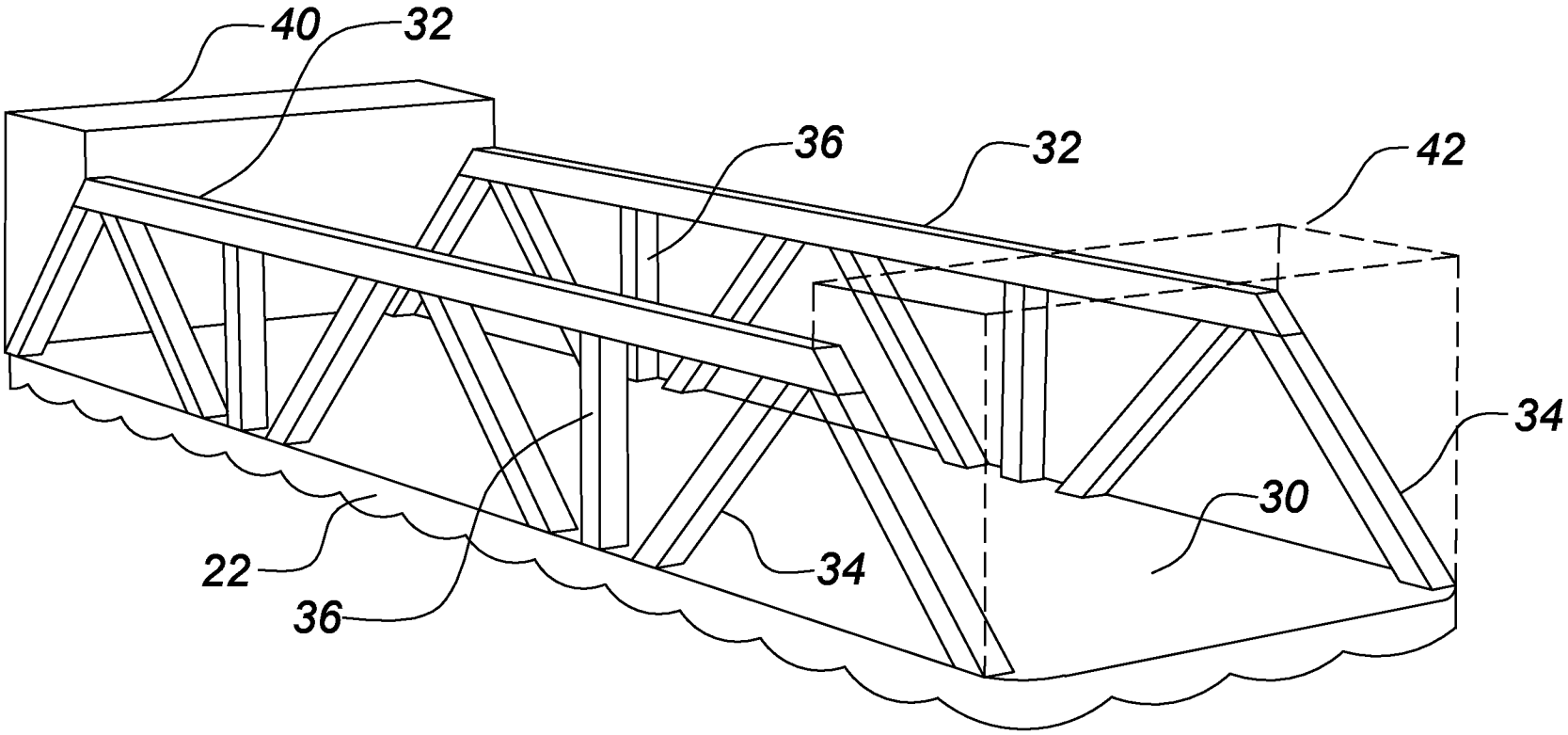
FIG. 3 is a perspective view of a ship according to a first embodiment of the present invention.
Figure 4:
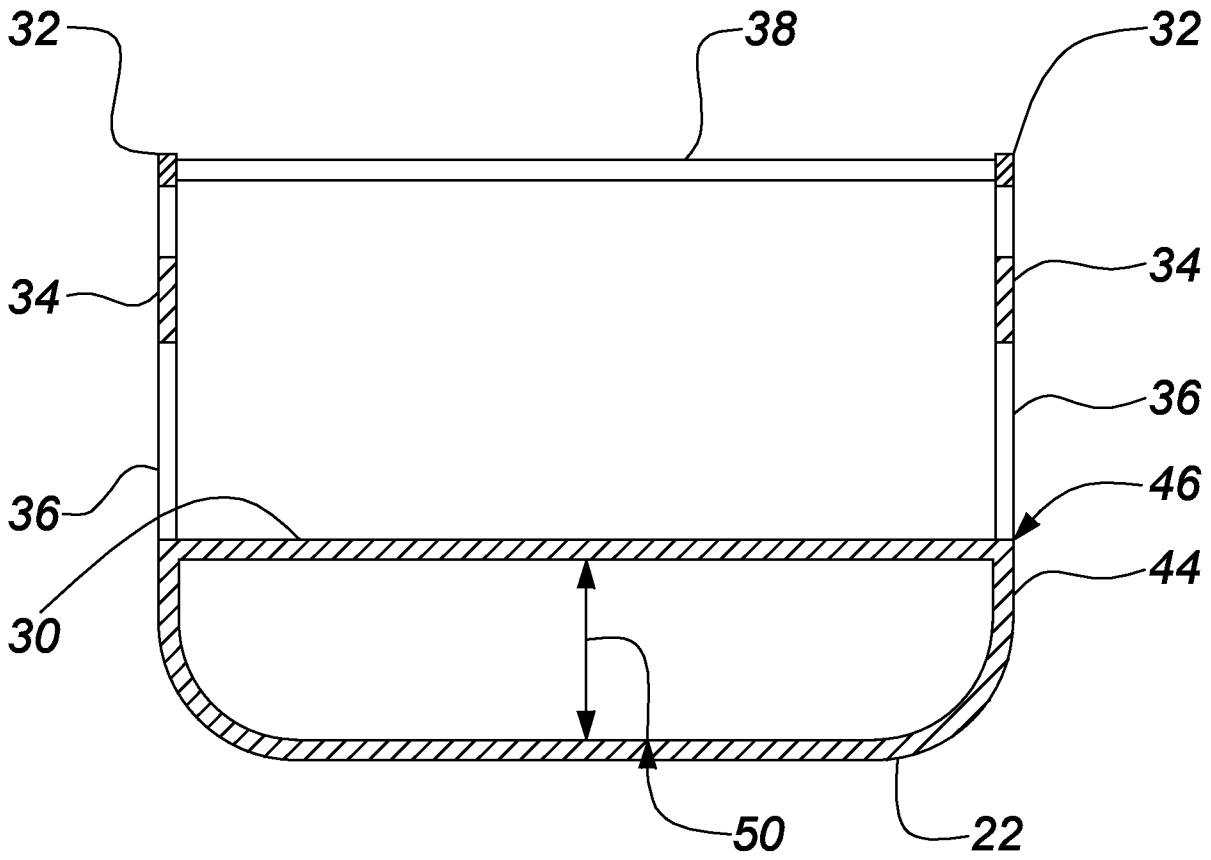
FIG. 4 is a cross sectional view of the ship of FIG. 3.
Figure 5:
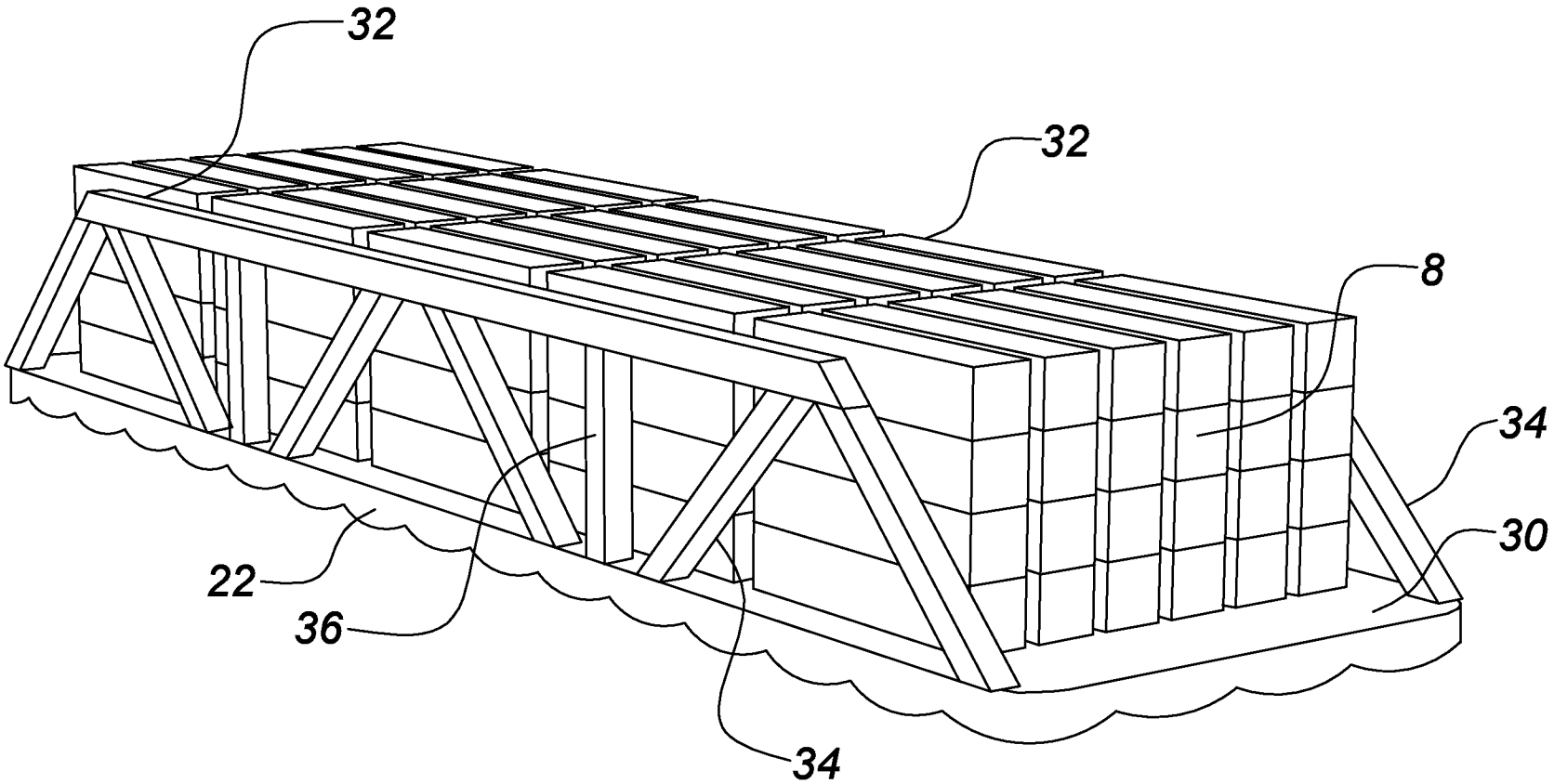
FIG. 5 is a perspective view of the ship of FIG. 3 having a plurality of containers located thereon.

Referring to FIGS. 3 through 5, a vessel for shipping containers 8 according to a first embodiment of the invention is shown generally at 20. The vessel 20 includes a hull 22 of any conventional shape extending along a central axis 24 between front and rear ends, 26 and 28, respectively. The vessel 20 also includes a main deck 30 spaced vertically above the hull 22 and attached thereto as is conventionally known. The main deck 30 is substantially horizontal and planar and is continuous to support a plurality of shipping containers 8 thereon as illustrated in FIG. 5. As illustrated in FIG. 4, the hull 22 may include a side 44 having a top edge 46 terminating at or proximate to the deck 30.

The vessel includes a pair of spaced apart horizontal beams 32 extending substantially along the length of the hull 22 at a position parallel to and spaced above the main deck 30. The beams 32 are connected to the hull 22 or the main deck 30 by a plurality of rigid angled and vertical supports 34 and 36, respectively. It will be appreciated that the beams 32 and angled and vertical supports 34 and 36 form trusses in conjunction with the main deck or hull so as to provide additional strength to the vessel. The beams 32 may be of any size or shape depending upon the size of the vessel and the strength requirements which they are to contribute to the longitudinal stiffness of the vessel such as by way of non-limiting example, H-section or box-section beams although it will be appreciated that other shapes may be utilized as well. In particular, the beams 32 may be designed to have a maximized section for a given weight. The beams 32 may be formed of any suitable material, such as by way of non-limiting example, steel, other metals, or composite materials. Similarly the angled and vertical supports 34 and 36 may be formed of similar materials and sizes and may be connected to the beams 32 and the hull 22 or the main deck 30 by any convention means such as by way of non-limiting example, welding, fasteners adhesives or a combination thereof.

The angled and vertical supports 34 and 36 may be secured to either the hull 22 or the main deck 30 and are located proximate to the side edges of the vessel to maximize the space therebetween. As illustrated in FIG. 3, the beams 32 may optionally include cross-braces 38 extending transversely across the vessel between the beams 32 so as to provide additional torsional and transverse rigidity to the vessel. The cross-braces 38 may be formed of a similar material as the beams 32 and supports 34 and 36 and may be secured thereto by any conventional means such as by way of non-limiting example, welding, fasteners, adhesives or any combination thereof.

As illustrated in FIGS. 3 and 5, the vessel 20 may optionally include stern and bow bodies, 40 and 42, respectively extending from the main deck 30 at locations proximate to the front and rear 26 and 28 of the vessel. As illustrated in FIG. 3, the bow body is shown in dashed lines to not obstruct the remainder of the vessel 20 although it will be appreciated that this structure is constructed similar to the stern body. It will be appreciated that one or both of the bow and stern bodies may optionally include operator accommodation or machinery therein. As illustrated in FIGS. 3 and 5, the beams 32 may terminate at bow and stern bodies so as to incorporate them into the overall strengthening structure of the vessel.

With reference to FIG. 5, in operation a plurality of shipping containers 8 may be located upon the main deck 30 between the beams 32. The beams provide additional strength to the vessel while permitting a low main deck height. In particular the height of the main deck above the hull (generally indicated at 50 in FIG. 4) can be minimized as much as only the necessary displacement of the vessel may so as dictate to maximize the height above the hull deck available to locate cargo upon. Accordingly the main deck 30 can be moved as low as the few inches above waterline and the space above deck can accommodate a full 8 tiers of containers, thereby increasing the efficiency of such shipping operations.

While specific embodiments of the invention have been described and illustrated, such embodiments should be considered illustrative of the invention only and not as limiting the invention as construed in accordance with the accompanying claims.

What is claimed is:

1. A marine vessel comprising:

a hull having a length enclosing an interior volume from above by a deck; and at least two beams each extending substantially parallel to said length of said hull at a position spaced above said deck, wherein said at least one beam is rigidly connected to and longitudinally reinforces said deck and said hull; and at least one cross brace extending between said two beams at a position spaced above said deck.

2. The marine vessel of claim 1 wherein said at least one beam includes a plurality of rigid members extending between said at least one beam and said deck.

3. The marine vessel of claim 2 wherein said at least one beam and said rigid members form a truss.

4. The marine vessel of claim 3 further including trusses adjacent to each longitudinal side of said hull.

5. The marine vessel of claim 3 further comprising bow and stern bodies extending above said main deck wherein said trusses are rigidly connected to said bow and stern.

6. The marine vessel of claim 5 wherein at least one of said bow and stern bodies includes personnel occupied space.

7. The marine vessel of claim 1 wherein said hull includes side walls having top edges proximate to said deck.

8. The marine vessel of claim 7 wherein said top edges of said side walls terminate at said deck.

* * * * *